US005429022A

United States Patent [19]

Nakayama

[11] Patent Number: 5,429,022

[45] Date of Patent: Jul. 4, 1995

[54] OPENING MACHINE FOR FILM SEAL CAP

[75] Inventor: Naoki Nakayama, Tokyo, Japan

[73] Assignee: Mitsubishi Yuka Bio-Clinical Laboratories, Inc., Tokyo, Japan

[21] Appl. No.: 52,830

[22] Filed: Apr. 27, 1993

[30] Foreign Application Priority Data

Apr. 28, 1992 [JP] Japan ..... 4-108237

[51] Int. Cl.[6] ..... B67B 7/48; B67B 7/82

[52] U.S. Cl. ..... 83/152; 83/154; 83/171

[58] Field of Search ..... 83/152, 151, 171, 153, 83/154

[56] References Cited

U.S. PATENT DOCUMENTS

| | | | |
|---|---|---|---|
| 3,581,605 | 6/1971 | Taylor . | |
| 3,821,850 | 7/1974 | Kowalyk . | |
| 4,131,042 | 12/1978 | Rich et al. | 83/152 |
| 4,187,662 | 2/1980 | Cochran . | |

FOREIGN PATENT DOCUMENTS

| | | |
|---|---|---|
| 0246900 | 11/1987 | European Pat. Off. . |
| 0373667 | 6/1990 | European Pat. Off. . |
| 1358336 | 3/1964 | France . |
| 1344424 | 1/1974 | United Kingdom . |

*Primary Examiner*—Hien H. Phan
*Attorney, Agent, or Firm*—Oblon, Spivak, McClelland, Maier & Neustadt

[57] ABSTRACT

A cap opening machine for a film seal cap, includes a hollow punch with a depressurizable space defined in a hollow portion thereof; a pressure regulating device for regulating pressure in the depressurizable space; and a punching-action causing mechanism for moving the punch and the cap relative to each other, whereby a punched-out piece, punched out by the punch, is processed by the action of a differential pressure between atmospheric pressure and the pressure in the depressurizable space. With the design, this cap opening machine can eliminate manual work of an operator that may cause infection, hardly contaminates the contents of containers, and shows high performance.

4 Claims, 7 Drawing Sheets

8
19
11
20
21
6
18
13
16
36
7
38
14
10
15
12
39
25
5
26
24
23
22
9
33
2
3
4
1
17

OPENING MACHINE FOR FILM SEAL CAP

BACKGROUND OF THE INVENTION

1. Field of the Invention

The present invention relates to a cap opening machine for film seal type caps, and, more particularly, to a cap opening machine for containers with film seal caps, which contain samples (blood or the like) for clinical examination.

2. Description of the Related Art

In general, containers for samples for clinical examinations (hereinafter called "sample containers"), which have film seal type caps, are small containers, like test tubes, with caps. To open the cap of a sample container for an examination, for example, to find the tap portion (see "37" in FIG. 2) of the cap, a manual work is actually involved.

In the manual cap opening, part of a sample may be splashed at the time the cap is opened, so that there is possible infection to the operator through the sample. Further, as caps are opened one after another with the same gloves on, if a sample sticks on the gloves, the sample in the next container to be opened may be contaminated. This will affect the examination result and will make the examination unreliable.

As cap opening machines for rubber caps and film seals, there have been developed a type which holds a rubber cap and pulls it out, and another type which flips a film open. Once a sample sticks on the cap holding portion of either cap opening machine, the sample in the next sample container to be opened may be contaminated at the time this container is opened. Further, as those machines are designed to process containers one at a time, their cap-opening performance is very poor and is not economical.

SUMMARY OF THE INVENTION

It is therefore an object of the present invention to provide a cap opening machine for film seal caps, which can eliminate manual work of an operator that may cause infection, hardly contaminates the contents of containers, and shows high performance.

To achieve the foregoing and other objects, a cap opening machine for a film seal cap according to the present invention comprises a hollow punch with a depressurizable space defined in a hollow portion thereof; pressure regulating means for regulating pressure in the depressurizable space; and punching-action causing means for moving the punch and the cap relative to each other, whereby a process for a punched-out piece punched out by the punch is carried out by the action of a differential pressure between atmospheric pressure and the pressure in the depressurizable space.

According to one preferable mode of the present invention, the cap opening machine further comprises a punched-out piece retaining section for retaining said punched-out piece, and pressurizing means for pressurizing said depressurizable space, whereby said process for said punched-out piece is to temporarily hold said punched-out piece at an entrance of said depressurizable space, and to set said pressure in said depressurizable space equal to or higher than atmospheric pressure to thereby discharge said punched-out piece toward said punched-out piece retaining section.

According to another preferable mode of the present invention, the cap opening machine further comprises means for moving said depressurizable space and said punch relatively, to at least relax a sticking state of said punched-out piece when sticking on said punch through a punching action, as said process for said punched-out piece.

According to still another preferable mode of the present invention, the cap opening machine further comprises means for heating said punch to or above 100° C.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Preferred embodiments of the present invention will now be described referring to the accompanying drawings.

First Embodiment

Figure 4:
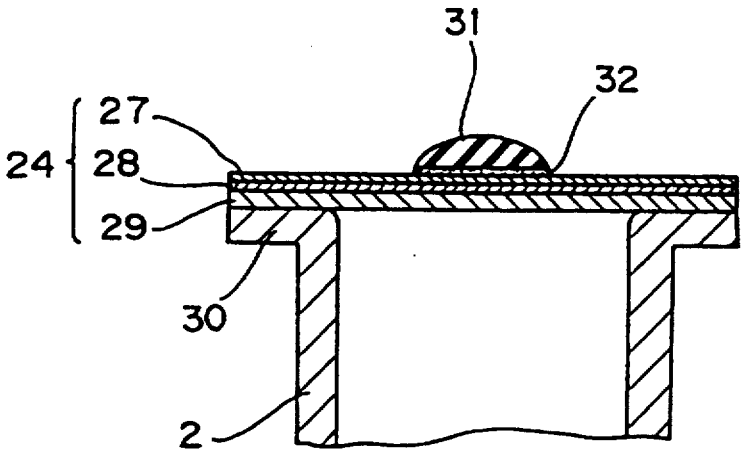
FIG. 4 is a cross section illustrating an example of a container, which is to be opened by the cap opening machine of the present invention, and its cap portion.

FIG. 4 is a cross section illustrating an example of a container, which is to be opened by the cap opening machine of the present invention, and its cap portion. A container body 2 has a flange 30 at the upper portion, and a cap 24 is welded to the flange 30. The cap 24 is made of a three-layer laminated film having a plastic film 24, an aluminum foil 28 and a thermoplastic resin film 29 from the top. A rubber projection 31 at the top of the cap 24 serves as a needle entry and is attached to the cap 24 with an adhesive 32. The inside of the container is under a vacuum so that the container can suck a sample, such as blood, inside through a needle.

The above paragraph has described just one example of a container cap. The present invention will not be limited by the laminated structure or the presence or absence of the rubber projection.

Figure 1:
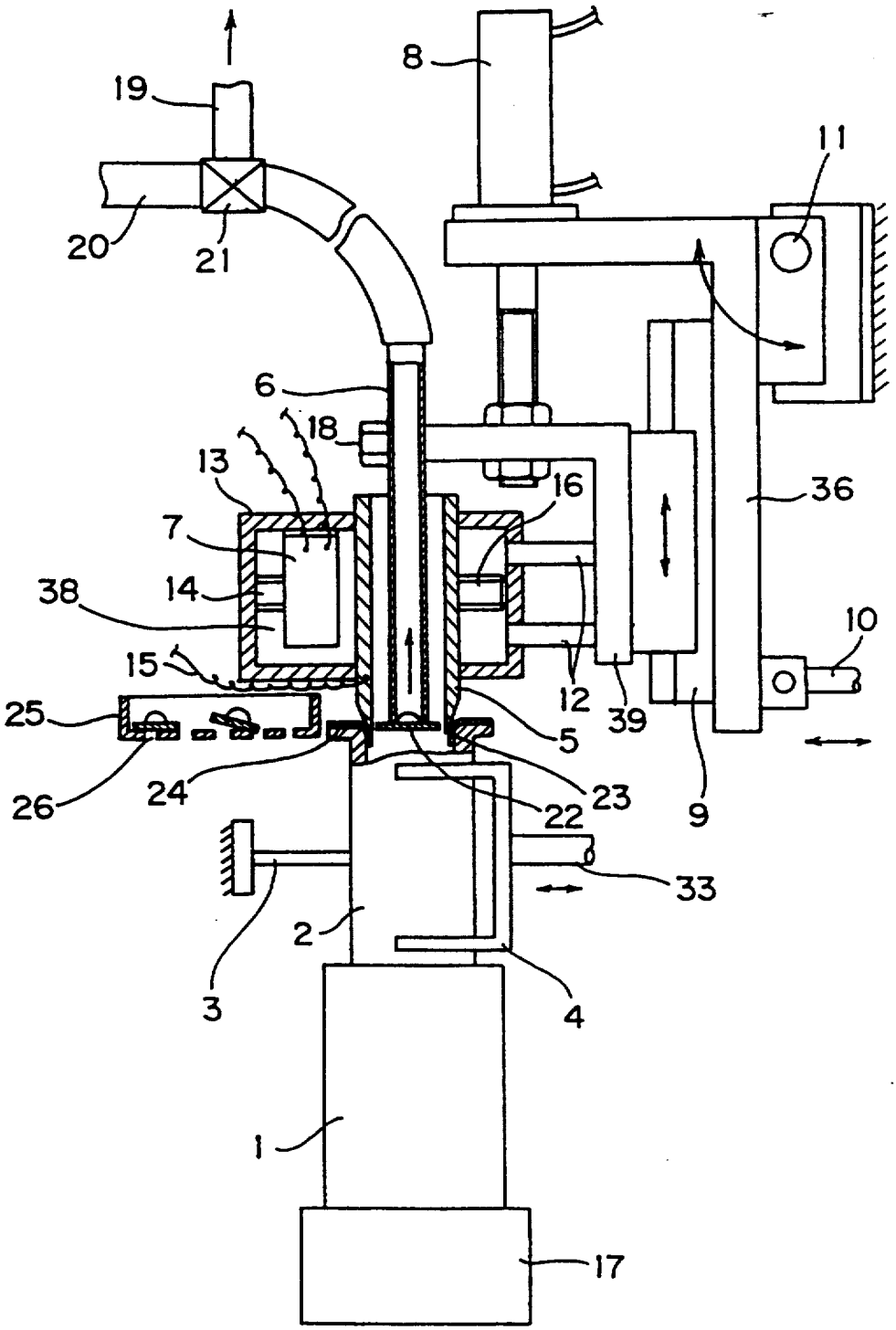
FIG. 1 is a partly cross-sectional side view illustrating a cap opening machine according to one embodiment of the present invention, which has just punched out a cap.

FIG. 1 is a partly cross-sectional side view of a cap opening machine according to one embodiment of the present invention. FIG. 1 illustrates a cap having just been punched out.

The container body 2 of the container to be opened stands on a container rack 1. The rack 1 is stopped at a predetermined position by a rack moving device 17 and a prescribed-position sensor (not shown). The container body 2 is held between a positioning member 4 and a guide 3 to be securely positioned.

Figure 3:
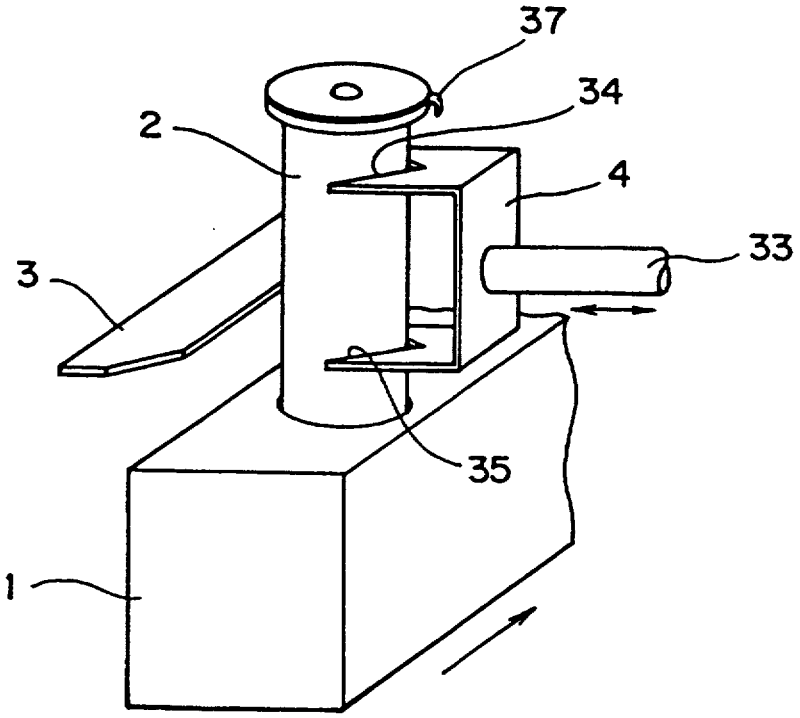
FIG. 3 is a perspective view showing a positioning member used in the cap opening machine in FIG. 1.

FIG. 3 is a perspective view showing a positioning member used in the cap opening machine in FIG. 1. The positioning member 4 is moved rightward and leftward by an air cylinder (not shown) through a positioning rod 33. The positioning member 4 has a bracket ("]") shape in cross section, and has notches 34 and 35 formed at those portions which will contact the container. The container is guided by the notches to be positioned accurately.

The positioning member may be designed properly in accordance with the shape of containers, the required positioning precision, or the like. Various design factors, such as the number of notches, the shape thereof and the contact position, are not limited to those of this embodiment illustrated above.

Returning to FIG. 1, the bottom of the hollow punch 5 is illustrated as having punched out the cap 24 whose center portion becomes a punched-out piece 22. The punched-out piece 22 is held at the bottom of a vacuum pipe 6.

The hollow punch 5 is mounted on a punching head 38 by set bolt 16. The punching head 38 is mounted on a slide member 39 by bolts 12. The slide member 39 is moved up and down along a slide rail 9 by an air cylinder 8.

According to this embodiment, the punch 5 is heated by a heater 7. A temperature sensor 15 is attached to measure and control the temperature of the punch 5. The heater 7 is secured to the punching head 38 by a set bolt 14. The entire punching head 38 is heat-insulated by a heat insulating member 13. The heater temperature is controlled to be between 100° to 300° C. and preferably 180° to 250° C. by the temperature sensor 15 and a temperature controller (not shown).

The piece 22, punched out by the downward action of the punch 5, is sucked and held by the vacuum pipe 6 that is attached to the slide member 39 by a set bolt 18.

Figure 2:
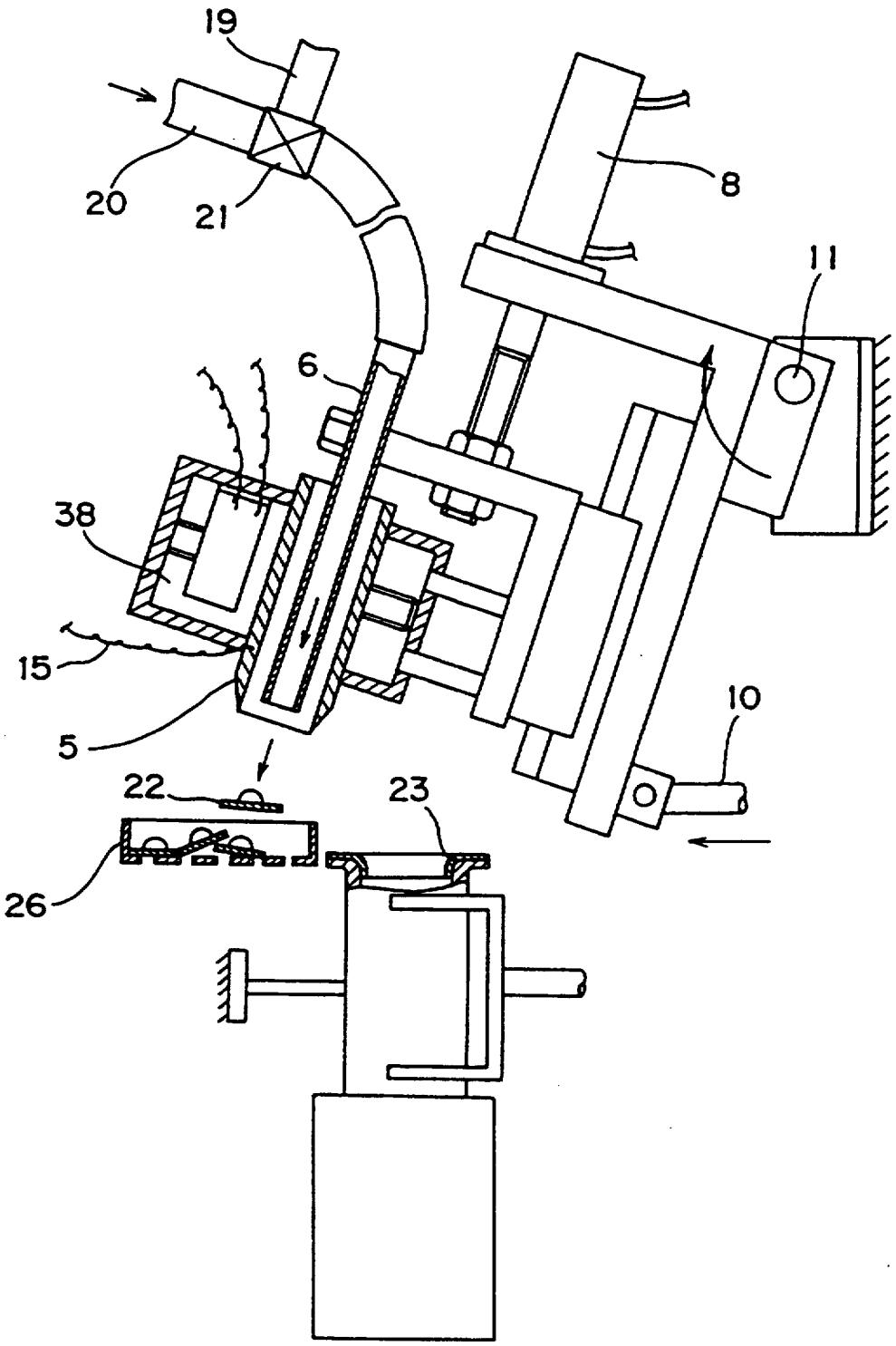
FIG. 2 is a partly cross-sectional side view of the cap opening machine in FIG. 1, illustrating a punched-out piece being discharged to a punched-out piece retaining section.

FIG. 2 is a partly cross-sectional side view of the cap opening machine in FIG. 1, illustrating a punched-out piece being discharged to a punched-out piece retaining section. The punch 5 and the punching head 38 are lifted up by the air cylinder 8 in this diagram. The whole part of a swing table 36 including a slide rail 9 is swung around a fulcrum 11 toward the upper left direction in the diagram. This swing is caused by an air cylinder (not shown) through a swing rod 10.

The punched-out piece 22, which is sucked and held at the bottom of the vacuum pipe 6 in FIG. 1, is discharged toward a punched-out piece retaining section 25 in FIG. 2. In this embodiment the retaining section 25 has a meshed bottom 26.

The discharging of the punched-out piece 22 is executed by the instantaneous switching of a three way valve 21 to a compressed air line 20 from a vacuum line 19. The degree of vacuum in this embodiment was 300 mmHg (0.4 atmospheric pressure), and the pressure of the compressed air was 2 kg/cm$^2$.

A part 23 of the remaining cap of the container 2 is pressed inside the container by the heated punch 5 as shown in FIG. 1.

The container 2 with the punched cap becomes free when the positioning member 4 moves rearward, and is moved by the rack moving device 17. One cycle of the punching head 38 is completed when the swing rod 10 moves rearward to the original position.

The punch 5 may take a shape of a cylinder, an elliptical cylinder, a rectangular cylinder, or the like depending on the shape of containers and the shape of holes to be made.

Figure 5:
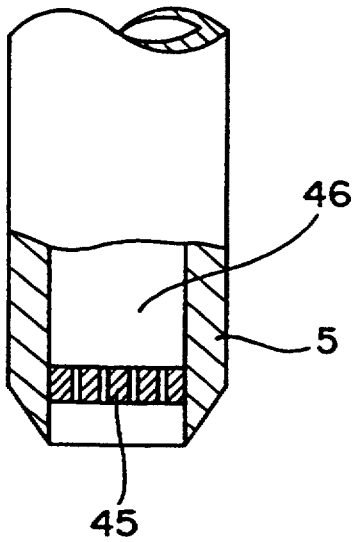
FIG. 5 is a cross section of a modification of a hollow punch designed in such a manner that the interior of this hollow punch itself is a depressurizable space.

In the above embodiment, a vacuum pipe is used as a depressurizable space defined in the hollow portion of the punch 5. But, the hollow portion of the punch 5 itself may be designed to be a depressurizable space 46 as shown in FIG. 5. In this case, if a perforated plate 45 is provided in the vicinity of the end of the hollow portion, a punched-out piece can be held at this portion. If an obstruction like the perforated plate 45 is not provided, a punched-out piece is carried through the depressurizable space, like dust sucked into a vacuum cleaner. In the latter case, however, as air is steadily sucked into the depressurizable space, the sample in the container may also be sucked into or the liquid level may be disturbed to splash the sample, depending on the degree of the depressurization.

Although a three way valve is illustrated as pressure regulating means for regulating the pressure in the depressurizable space, this means is not limited to that valve. A four way valve may also serve as such means. When no compressed air is used to discharge a punched-out piece (as in the case where the punched-out piece falls due to the dead weight), the compressed air line in the above embodiment can be replaced with an atmospheric pressure line.

Although a mechanism to move the punch up and down is illustrated as punching-action causing means, a container may be moved up and down instead.

It is preferable that the punch be heated to 100° C. or higher. The particularly preferable temperature range is between 180° C. and 250° C. The heating quickly evaporates and solidifies the sample sticking on the punch, and kills microbes or viruses in the stuck sample, thus preventing contamination among samples.

Waste from the cap, when punched out, may fly away. But, such cap waste will not fall inside the container because the plastic portion of the laminated film is instantaneously melted or softened by the heated punch, or the wastes are welded to the punched-out cap or to the inner wall of the container.

The means or device to heat the punch is unnecessary in the case where there is no chance of producing punched wastes or no chance of infection or contamination.

The cap opening machine of the present invention may be designed to have a plurality of punching heads arranged in parallel for multiple punching in order to improve the performance. In this case, when the rack is designed to retain a plurality of containers in the direction of the forward movement, those containers can be opened all at once.

A different type of container of a size other than a predetermined size may be mixed into containers on the rack. The cap opening machine may be designed in such a way that at the time the rack is supplied, the heights and widths of the individual containers are detected and signals representing the sizes are sent to the associated cap-punching air cylinders to avoid punching out the cap of such a different type of container. When the vacuum line is connected to another punching line, the degree of vacuum cannot be secured. In this case, a four way valve should be used instead of a three way valve as the switching valve so that at the time of punching containers of another given size, the degree of vacuum of the associated vacuum line can be maintained at or above a constant level. Alternatively, an openable and closable, two way valve may be provided in series on that side of the vacuum line where the vacuum is produced, so that the degree of vacuum at the time of punching containers of another given size can be secured by closing the two way valve of the vacuum line of the punching head portion corresponding to a different type of container.

Second Embodiment

In the cap opening machine of the first embodiment, some other problems may arise rarely. A second embodiment as shown below is equipped with means to prevent such problems from occurring.

The first possible problem arises due to the heating of the punch 5 that is applied to prevent contamination. It rarely occurs that when the cap 24 is punched out by the punching head 38, the plastic portion 27 of the punched-out piece 22 sticks on a blade tip 57 of the punch 5, so that the punched-out piece 22 will not be blown downward even by the compressed air blowing through the vacuum pipe 6.

To prevent such problem, drive means such as an air cylinder 53 is additionally provided on the slide member 39 and is secured to the vacuum pipe 6 by an attaching member 55. To give sufficient flexibility to a tube 54 which connects the vacuum pipe 6 and the three way valve 21, the tube 54 is replaced with the one which is made of a highly flexible material, such as a rubber tube or vinyl tube or a bellows structure of such tube.

It is thus possible to allow the punch 5 and vacuum pipe 6 to make relative motion in the lengthwise direction by activating and deactivating the air cylinder 53.

Figure 6:
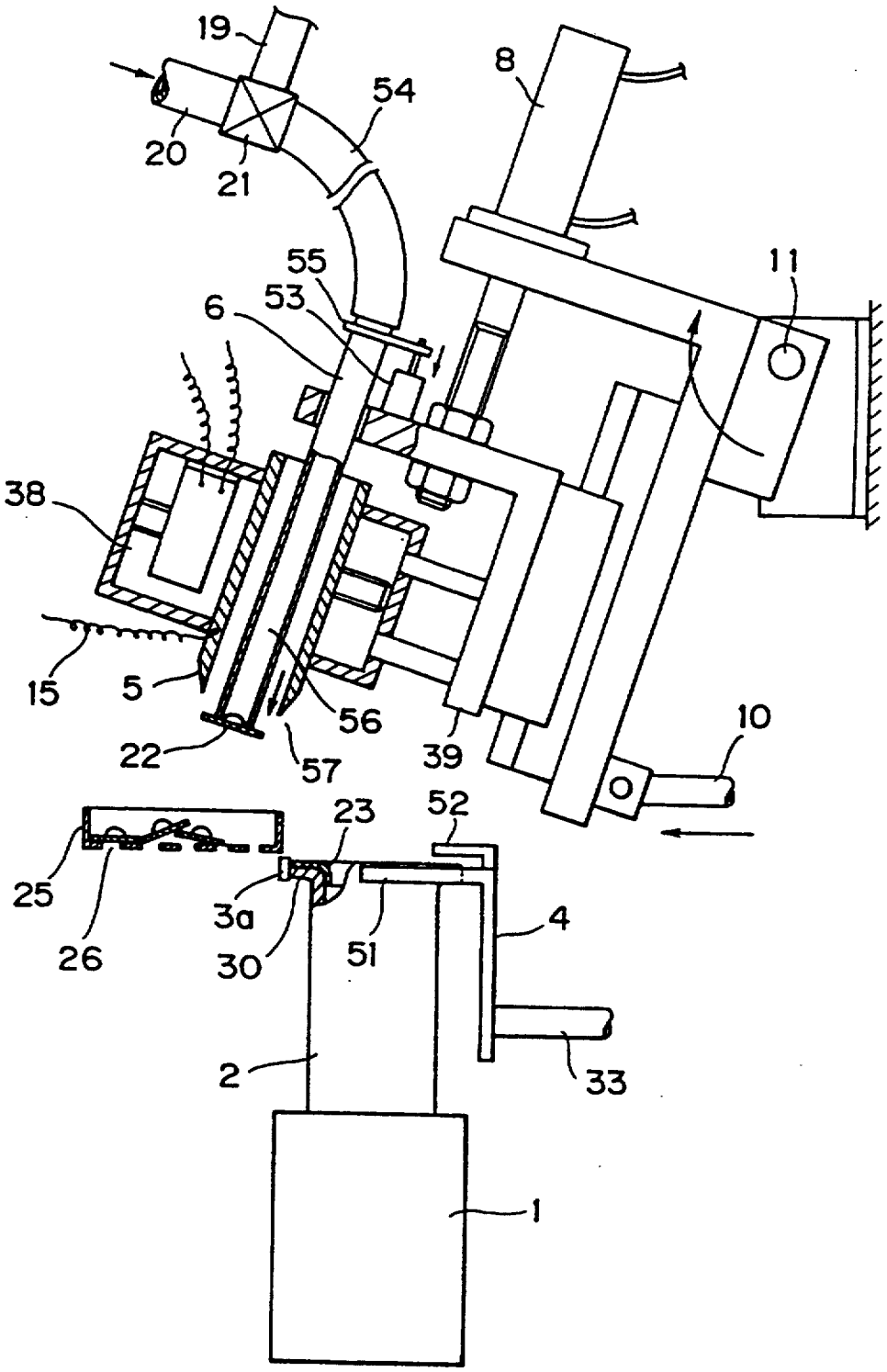
FIG. 6 is a partly cross-sectional side view illustrating the general structure of a cap opening machine according to a second embodiment of the present invention at the time a punched-out piece is discharged into a punched-out piece retaining section.

More specifically, after the punched-out piece 22 is punched out from the cap 24, the entire punching head 38 including the punch 5 is swung around the fulcrum 11 and then the air cylinder 53 is activated to forcibly separate the punched-out piece 22 from the blade tip 57 of the punch 5. Then, air under normal pressure or pressurized air is fed to the vacuum pipe 6 to drop the punched-out piece 22. This state is illustrated in FIG. 6.

The second possible problem after the completion of the punching operation is that when the punch 5 is intended to return to its home position for a preparative operation to swing the punching head 38, the entire container body 2 may be lifted upward together with the punch 5 due to the aforementioned heating of the punch 5.

Figure 8:
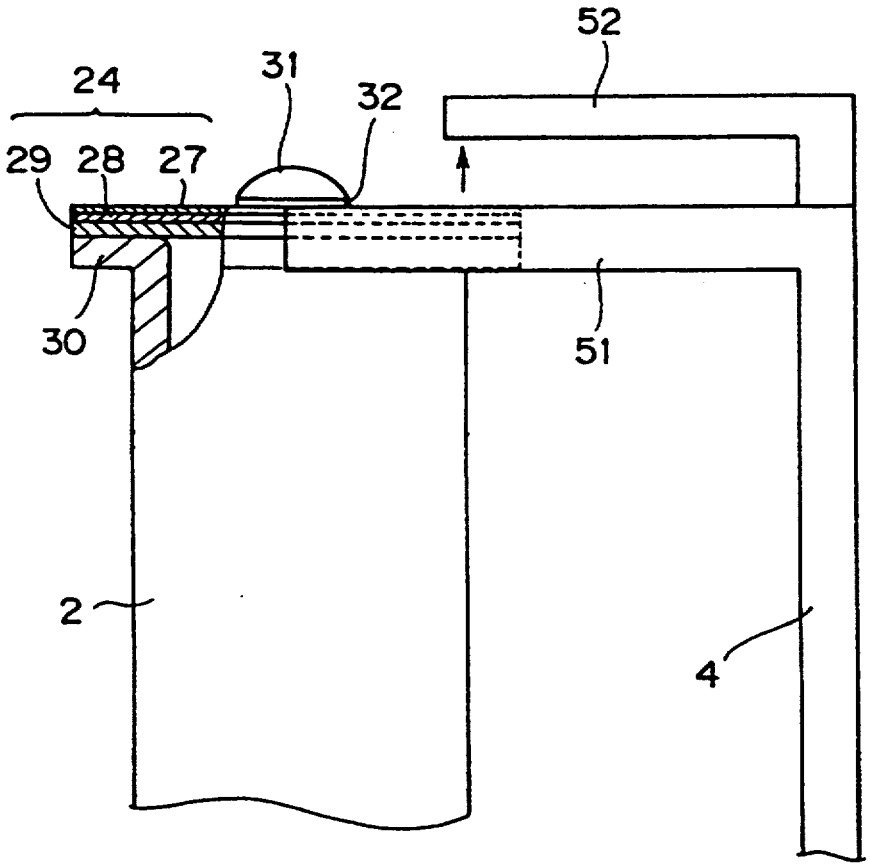
FIG. 8 is a cross section illustrating the positional relationship between a container, a cap, a flange, the positioning member and the stopper in the second embodiment shown in FIG. 6.
Figure 1:
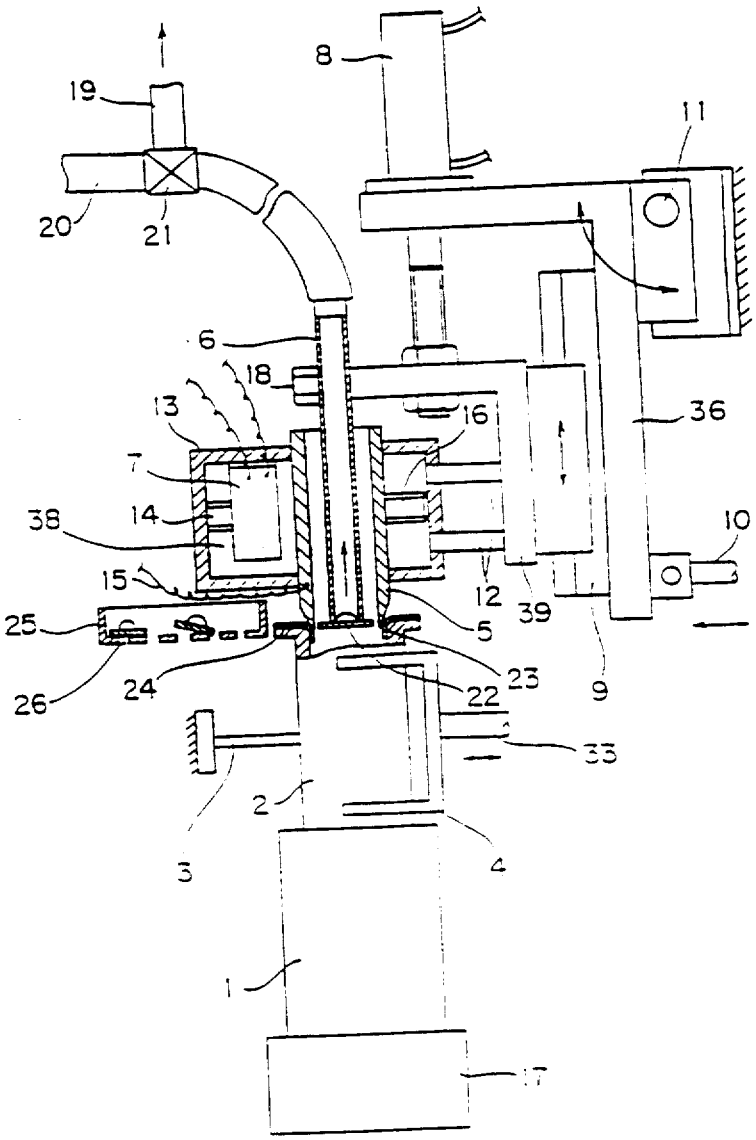
Figure 2:
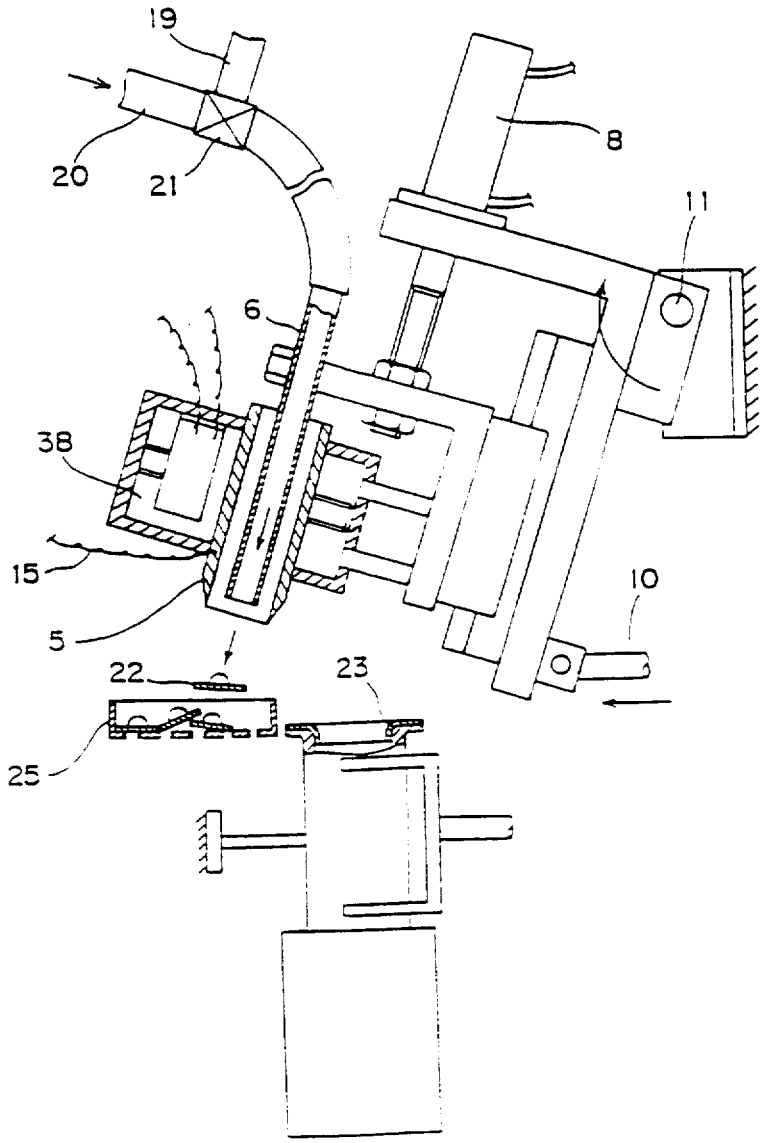

Although there is a very small possibility of this problem, as shown in FIG. 8, a stopper 52 is fixed above a finger portion 51 provided at the top of the positioning member 4 to inhibit upward movement of the container body 2.

There is another problem with respect to securely holding the container 2. The method of securing the container 2 as shown in the first embodiment locks the body portion of the container 2 as specifically illustrated in FIG. 3. In handling containers whose body portions have different diameters, the containers may not be properly centered with this method, so that securely positioning cannot be accomplished.

As each container 2 is likely to be placed in a container holder to collect blood, the diameters of the flanges 30 of the containers 2 are standardized so as to be the same. The present inventor has paid attention to this fact and has hit upon the idea of using the flange 30 of a standardized size as a locking position.

Figure 7:
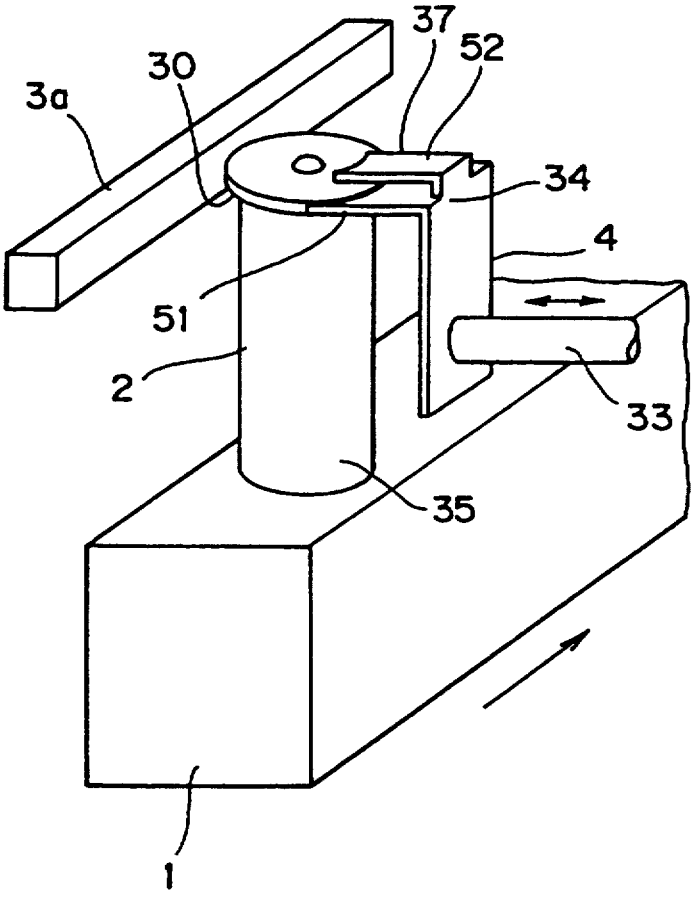
FIG. 7 is perspective view showing a positioning member and a stopper in the second embodiment shown in FIG. 6.

FIG. 7 presents a perspective view illustrating that the flange 30 of the container 2 is held and locked between the finger portion 51 and a guide 3*a* which is positioned in association with the stopper.

It is apparent from the above, the cap opening machine of the present invention has the following effects.

(1) As this machine employs a punching system, it exhibits a better performance than the conventional cap opening machines which flip a cap open or pull out a rubber stopper.

(2) As the punched-out piece can be automatically handled, it will not fall into the container.

(3) Because no manual work is involved, it is possible to prevent undesirable infection or the like that may occur at the time the cap is opened.

(4) When the punch is heated, a sample sticking on the punch can be sterilized and dried, thus preventing contamination among samples.

(5) When the punch is heated, punching waste can be welded to the top portion of the inner wall of the container so that the sample inside the container will not be contaminated externally.

(6) As the punch is compact, it is possible to arrange cap opening machines in parallel for multiple punching, thereby further improving the punching performance.

(7) The punched-out piece can assuredly be dropped.

(8) There is no chance that the whole container is stuck with the punch and moves together with the punch.

(9) It is possible to reliably fix even containers having different body sizes.

Obviously, numerous modifications and variations of the present invention are possible in light of the above teachings. It is therefore to be understood that within the scope of the appended claims, the invention may be practiced otherwise than as specifically described herein.

What is claimed is:

1. A cap opening machine for a film seal cap comprising:

a hollow punch with a depressurizable space defined in a hollow portion thereof for puncturing said seal cap by respective movement of said punch and seal cap towards one another;

a pressure regulating mechanism which regulates pressure in said depressurizable space;

a punching-action causing mechanism for moving said punch and said cap relative to each other so as to puncture said seal cap wherein said punch is exclusively located on one side of said seal cap, wherein a piece of said cap is punched out by said punch and said piece is removed by action of a differential pressure between atmospheric pressure and said pressure in said depressurizable space after said puncture of said seal cap; and a depressurizing mechanism at least partially surrounded by said hollow punch and within which said depressurizing space is located; and a swing mechanism connected to said hollow punch and said depressurizing mechanism for swinging said hollow punch and said depressurizing mechanism together about a fulcrum away from said punctured seal cap for discharge of said punched out piece of said seal cap from said hollow punch.

2. The cap opening machine according to claim 1, further comprising:

a punched-out piece retaining section for retaining said punched-out piece; and wherein said punched-out piece is temporarily held at an entrance of said depressurizable space, and said pressure in said depressurizable space is set so as to be equal to or greater than atmospheric pressure to thereby discharge said punched-out piece toward said punched-out piece retaining section.

3. A cap opening machine for a film seal cap comprising;

a hollow punch with a depressurizable space defined in a hollow portion thereof for puncturing said seal cap by respective movement of said punch and seal cap towards one another;

a pressure regulating mechanism for regulating pressure in said depressurizable space;

a punching-action causing mechanism for moving said punch and said cap relative to each other so as to puncture said seal cap, wherein a piece of said cap is punched out by said punch and said punched out piece is removed by action of a differential pressure between atmospheric pressure and said pressure in said depressurizable space after said puncture of said seal cap; and a depressurizing mechanism at least partially surrounded by said hollow punch and within which said depressurizing space is located; and a mechanism for moving said depressurizable space and said punch relative to one another, to at least relax a sticking state of said punched-out piece when sticking on said punch through a punching action.

4. The cap opening machine according to claim 1, further comprising mechanism for heating said punch to or above 100° C.

* * * * *

UNITED STATES PATENT AND TRADEMARK OFFICE

CERTIFICATE OF CORRECTION

PATENT NO. : 5,429,022
DATED : July 4, 1994
INVENTOR(S) : Naoki Nakayama

It is certified that error appears in the above-identified patent and that said Letters Patent is hereby corrected as shown below:

Drawings:

Title page, showing an illustrative figure, should be deleted and substitute therefor the attached title page.

Delete drawing sheets 1-2, and substitute therefor the drawing sheets, consisting of Figs. 1-2, as shown on the attached pages.

Column 1, line 17, change "Fig. (2)" to --Fig. (3)--.

Signed and Sealed this

Twenty-third Day of January, 1996

*Attest:*

Bruce Lehman

BRUCE LEHMAN

*Attesting Officer*

*Commissioner of Patents and Trademarks*

United States Patent [19]

Nakayama

[11] Patent Number: 5,429,022

[45] Date of Patent: Jul. 4, 1995

[54] OPENING MACHINE FOR FILM SEAL CAP

[75] Inventor: Naoki Nakayama, Tokyo, Japan

[73] Assignee: Mitsubishi Yuka Bio-Clinical Laboratories, Inc., Tokyo, Japan

[21] Appl. No.: 52,830

[22] Filed: Apr. 27, 1993

[30] Foreign Application Priority Data

Apr. 28, 1992 [JP] Japan ..... 4-108237

[51] Int. Cl.° ..... B67B 7/48; B67B 7/82

[52] U.S. Cl. ..... 83/152; 83/154; 83/171

[58] Field of Search ..... 83/152, 151, 171, 153, 83/154

[56] References Cited

U.S. PATENT DOCUMENTS

| | | | |
|---|---|---|---|
| 3,581,605 | 6/1971 | Taylor . | |
| 3,821,850 | 7/1974 | Kowalyk . | |
| 4,131,042 | 12/1978 | Rich et al. | 83/152 |
| 4,187,662 | 2/1980 | Cochran . | |

FOREIGN PATENT DOCUMENTS

| | | |
|---|---|---|
| 0246900 | 11/1987 | European Pat. Off. . |
| 0373667 | 6/1990 | European Pat. Off. . |
| 1358336 | 3/1964 | France . |
| 1344424 | 1/1974 | United Kingdom . |

*Primary Examiner*—Hien H. Phan

*Attorney, Agent, or Firm*—Oblon, Spivak, McClelland, Maier & Neustadt

[57] ABSTRACT

A cap opening machine for a film seal cap, includes a hollow punch with a depressurizable space defined in a hollow portion thereof; a pressure regulating device for regulating pressure in the depressurizable space; and a punching-action causing mechanism for moving the punch and the cap relative to each other, whereby a punched-out piece, punched out by the punch, is processed by the action of a differential pressure between atmospheric pressure and the pressure in the depressurizable space. With the design, this cap opening machine can eliminate manual work of an operator that may cause infection, hardly contaminates the contents of containers, and shows high performance.

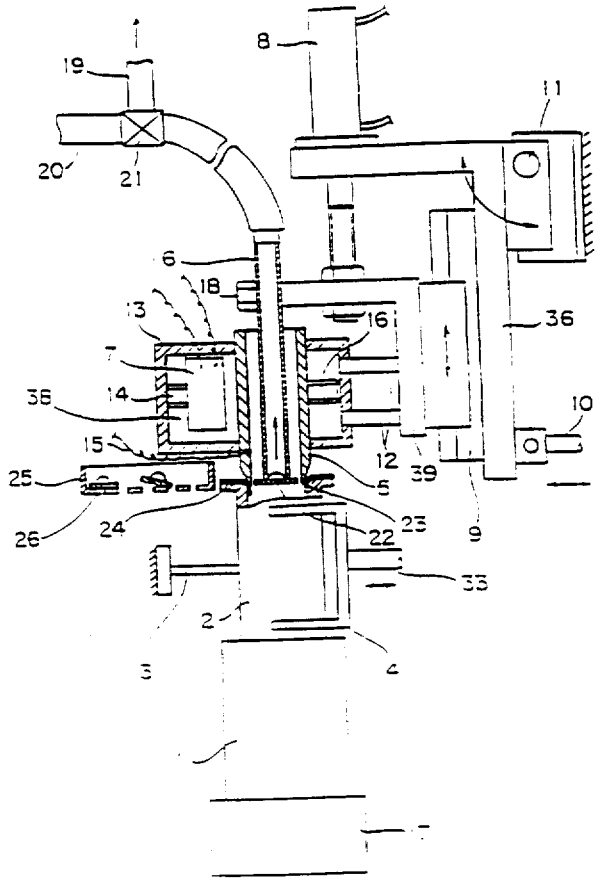

4 Claims, 7 Drawing Sheets